US006581573B2

(12) United States Patent
Nimura et al.

(10) Patent No.: US 6,581,573 B2
(45) Date of Patent: Jun. 24, 2003

(54) COMPOUND ELECTROMAGNETIC VALVE, HIGH PRESSURE PUMP AND APPARATUS FOR CONTROLLING HIGH PRESSURE PUMP

(75) Inventors: Hiroyoshi Nimura, Aichi-ken (JP); Yoshiharu Takemoto, Toyota (JP); Koji Kasahara, Toyota (JP); Toshiaki Yamamoto, Toyota (JP); Takashi Takemoto, Toyota (JP); Kazunari Hashimoto, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 116 days.

(21) Appl. No.: 09/960,480

(22) Filed: Sep. 24, 2001

(65) Prior Publication Data

US 2002/0035988 A1 Mar. 28, 2002

(30) Foreign Application Priority Data

Sep. 25, 2000 (JP) ..... 2000-290704

(51) Int. Cl.[7] ..... F02M 37/04
(52) U.S. Cl. ..... 123/496; 123/504
(58) Field of Search ..... 123/496, 504, 123/458, 449, 450, 456

(56) References Cited

U.S. PATENT DOCUMENTS 4,073,275 A * 2/1978 Hofer et al. ..... 417/289
6,192,864 B1 * 2/2001 Nishimura ..... 123/458
6,447,273 B1 * 9/2002 Nishimura et al. ..... 417/505

FOREIGN PATENT DOCUMENTS

JP 60-47874 4/1985
JP 10-73064 3/1998

* cited by examiner

*Primary Examiner*—Mahmoud Gimie
(74) *Attorney, Agent, or Firm*—Kenyon & Kenyon

(57) ABSTRACT

An electromagnetic control valve has a passage for conducting fluid. An electromagnetic actuator generates an electromagnetic force. A main valve body opens and closes the passage in accordance with the electromagnetic force generated by the electromagnetic actuator. A bypass is formed in the main valve body. A sub valve body opens and closes the bypass in accordance with the electromagnetic force generated by the electromagnetic actuator. The electromagnetic force generated by the electromagnetic actuator is adjusted such that the sub valve body is opened and closed while the main valve body closes the passage.

13 Claims, 15 Drawing Sheets

COMPOUND ELECTROMAGNETIC VALVE, HIGH PRESSURE PUMP AND APPARATUS FOR CONTROLLING HIGH PRESSURE PUMP

BACKGROUND OF THE INVENTION

The present invention relates to a compound electromagnetic valve, a high pressure pump that uses the compound electromagnetic valve, and an apparatus for controlling the high pressure pump.

A typical internal combustion engine includes a high pressure fuel pump, which is connected to an electromagnetic valve. The electromagnetic valve controls the flow of fuel that is supplied to the high pressure pump. The electromagnetic valve includes a valve body, which is urged by a spring. The valve body adjusts the opening of a fuel passage. When the valve is closed, the valve body as pressed against a valve seat not only by the force of the spring but also by a force based on the difference between the pressures acting on opposite sides of the valve body. Thus, when opening the valve again, a force that is large enough to separate the valve body from the valve seat against the force based on the pressure difference must be applied to the valve body. This requires a relatively large electromagnetic valve and a relatively high electric current.

To solve this problem, an electromagnetic valve having two valve bodies was introduced in Japanese Unexamined Utility Model Publication No. 60-47874. The electromagnetic valve of the publication includes a first valve body and a second valve body for controlling the opening of a fuel passage. The first valve body is cylindrical and accommodates the second valve body. The second valve body selectively closes a fuel bleed passage, which is formed in the first valve body. The valve also includes a solenoid that directly actuates only the second valve body. The second valve body is separated from the first valve body to open the bleed passage. Thereafter, when the second valve body is moved by a predetermined distance, the second valve body is engaged with the first valve body, which causes the first valve body to open the fuel passage. Since the second valve body first opens the bleed passage, the pressure difference across the first valve body is eliminated. Thus, the force required for opening the fuel passage is reduced. Accordingly, the size of the electromagnetic valve and the level of the current supplied to the valve are reduced.

However, since movement of the first valve body is dependent on movement of the second valve body, the opening of the fuel passage cannot be finely controlled. Thus, the following functions cannot be achieved by the electromagnetic valve of the publication. For example, depending on the condition of the high pressure fuel pump, fine adjustment of the fuel flow must be accomplished by controlling the opening of the bleed passage. In this case, only the second valve body must be controlled. In another condition, the fuel flow must be quickly increased. In this case, the first valve body must open the fuel passage immediately after the second valve body opens the bleed passage, that is, the first and second valve bodies must be moved substantially at the same time. In another condition, the period from when the second valve body opens the bleed passage to when the first valve body opens the fuel passage must be extended such that the pressure difference across the first valve body is reliably eliminated.

BRIEF SUMMARY OF THE INVENTION

Accordingly, it is an objective of the present invention to provide an electromagnetic valve having compound valve bodies that finely controls the opening of a passage. Other objectives are to provide a high pressure pump that uses the electromagnetic valve for finely controlling the fluid flow and to provide an apparatus for controlling the high pressure pump.

To achieve the above objective, the present invention provides an electromagnetic control valve comprises a passage for conducting fluid. An electromagnetic actuator generates an electromagnetic force. A main valve body opens and closes the passage in accordance with the electromagnetic force generated by the electromagnetic actuator. A bypass is formed in the main valve body. A sub valve body opens and closes the bypass in accordance with the electromagnetic force generated by the electromagnetic actuator. The electromagnetic force generated by the electromagnetic actuator is adjusted such that the sub valve body is opened and closed while the main valve body closes the passage.

The present invention also provides a high pressure pump. The high pressure pump comprises a high pressure chamber A passage supplies fluid to the high pressure chamber. An electromagnetic control valve controls the amount of fluid that enters the high pressure chamber through the passage. the electromagnetic control valve comprises an electromagnetic actuator for generating an electromagnetic force. A main valve body opens and closes the passage in accordance with the electromagnetic force generated by the electromagnetic actuator. A bypass is formed in the main valve body. The bypass connects an upstream part of the main valve body to a downstream part of the main valve body. A sub valve body opens and closes the bypass in accordance with the electromagnetic force generated by the electromagnetic actuator. The electromagnetic force generated by the electromagnetic actuator is adjusted such that the sub valve body is opened and closed while the main valve body closes the passage.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
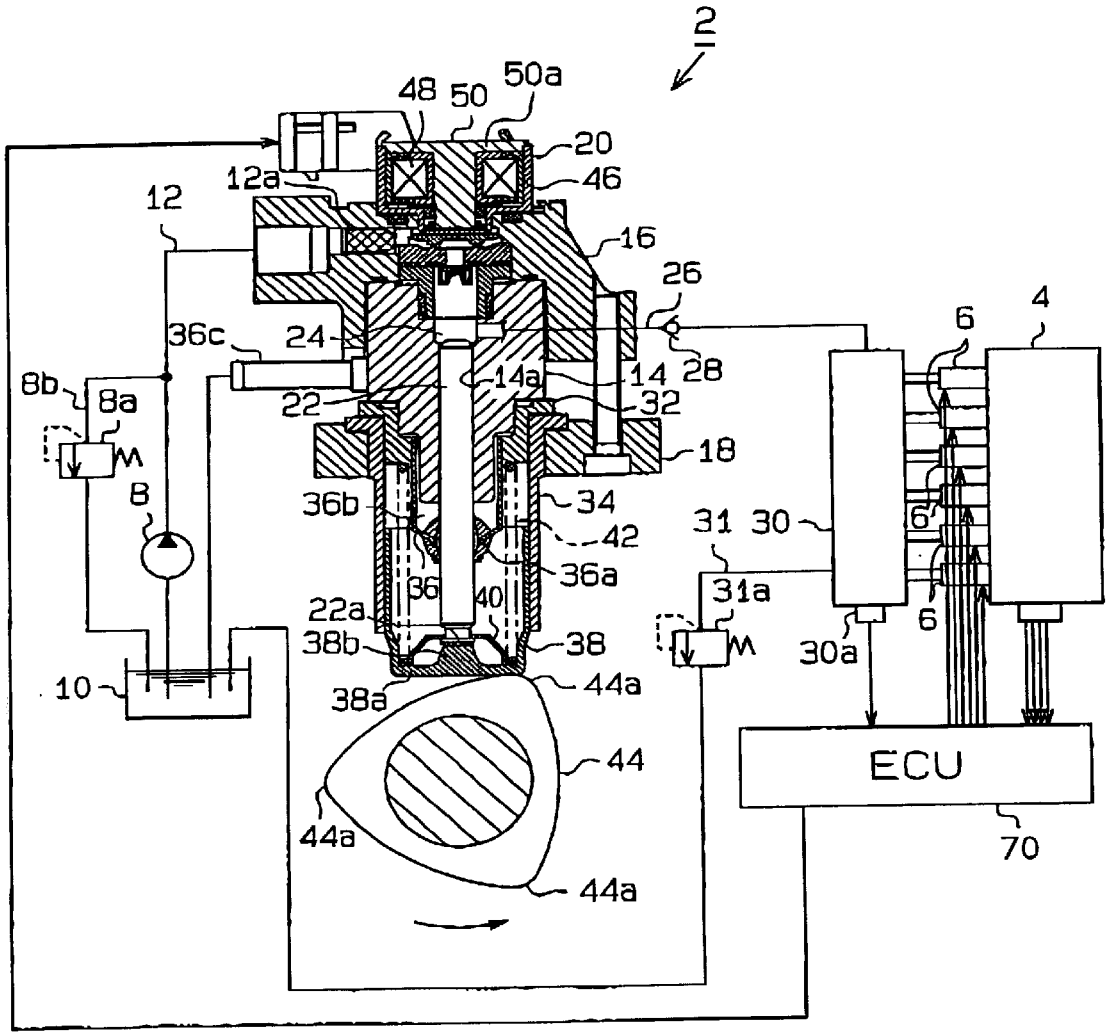
FIG. 1 is a cross-sectional view illustrating a high pressure pump, a fuel supply system and a control system according to a first embodiment of the present invention.

FIG. 1 illustrates a high pressure fuel pump 2, a fuel supply system and a control system according to one embodiment of the present invention. The high pressure fuel pump 2 supplies pressurized fuel to an in-cylinder fuel injection type gasoline engine 4, which has six cylinders. The engine 4 performs stratified charge combustion and homogeneous charge combustion. Pressurized fuel that is supplied to the engine 4 from the high pressure fuel pump 2 is directly injected into each combustion chamber through a corresponding fuel injector 6. A feed pump 8 draws fuel from a fuel tank 10 and supplies the fuel to the pump 2 through a fuel supply passage 12, which has a filter 12*a*. After pumped up by the feed pump 8, some of the fuel is not drawn by the high pressure fuel pump 2 and is returned to the fuel tank 10 through a relief passage 8*b*, which has a relief valve 8*a*.

The fuel pump 2 includes a cylinder body 14, a cover 16, a flange 18 and a fuel flow control electromagnetic valve 20. A cylinder 14*a* is formed along the axis of the cylinder body 14. A plunger 22 is accommodated in the cylinder 14*a*. A pressurizing chamber 24 is defined at the upper portion of the cylinder 14*a*. The volume of the pressurizing chamber 24 varies in accordance with the movement of the plunger 22. The pressurizing chamber 24 is connected to a discharge check valve 28 through a fuel passage 26. The discharge check valve 28 is connected to a fuel distribution pipe 30 by the fuel passage 26. The discharge check valve 28 is opened when the fuel pressure in the pressurizing chamber 24 is increased, which sends pressurized fuel to the distribution pip 30. When the flow rate of fuel sent to the distribution pipe 30 exceeds the level that is required for fuel injection, excessive fuel is returned to the fuel tank 10 through a relief passage 31, which has a relief valve 31*a*. This limits the fuel pressure.

A spring seat 32 and a lifter guide 34 are located between the cylinder body 14 and the flange 18. A substantially cylindrical oil seal 36 is attached to the inner surface of the spring seat 32. The lower portion 36*a* of the oil seal 36 slidably contacts the outer surface of the plunger 22. Fuel that has leaked through the space between the plunger 22 and the cylinder 14*a* is stored in a fuel storage chamber 36*b* in the oil seal 36. The fuel is then returned to the fuel tank 10 through a fuel draining pipe 36*c*, which is connected to the fuel storage chamber 36*b*.

A lifter 38 is slidably accommodated in the lifter guide 34. A projection 38*b* is formed on the inner surface of a bottom 38*a* of the lifter 38. The projection 38*b* contacts a lower end 22*a* of the plunger 22. The lower end 22*a* of the plunger 22 is engaged with a retainer 40. A spring 42 is located between the spring seat 32 and the retainer 40. The spring 42 is compressed and presses the lower end 22*a* of the plunger 22 against the projection 38*b* of the lifter 38. Due to the force applied by the lower end 22*a* of the plunger 22, the bottom 38*a* of the lifter 38 contacts a cam 44 of a fuel pump. The fuel pump cam 44 is attached to an intake camshaft in this embodiment and rotates as the engine 4 runs. Alternatively, the fuel pump cam 44 may be attached to an exhaust camshaft. As the cam 44 rotates, one of the cam noses 44*a* of the cam 44 lifts the lifter bottom 38*a*, which lifts the lifter 38. Accordingly, the plunger 22 is lifted to reduce the volume of the pressurizing chamber 24. The lifting stroke is the compression stroke of the pressurizing chamber 24. During the compression stroke, fuel starts being pressurized when the volume of the pressurizing chamber 24 becomes equal the amount of liquid fuel that has been drawn into the pressurizing chamber 24. The pressurized fuel pushes open the discharge check valve 28 and flows to the fuel distribution pipe 30.

When each cam nose 44*a* moves away, the lifter 38 and the plunger 22 are lowered by the force of the spring 42, which increases the volume of the pressurizing chamber 24. The lowering stroke is the intake stroke. During the intake stroke, the pressurizing chamber 24 draws fuel from the fuel supply passage 12. The amount of drawn fuel corresponds to the period during which the fuel flow control valve 20 opens the passage 12.

Figure 2:
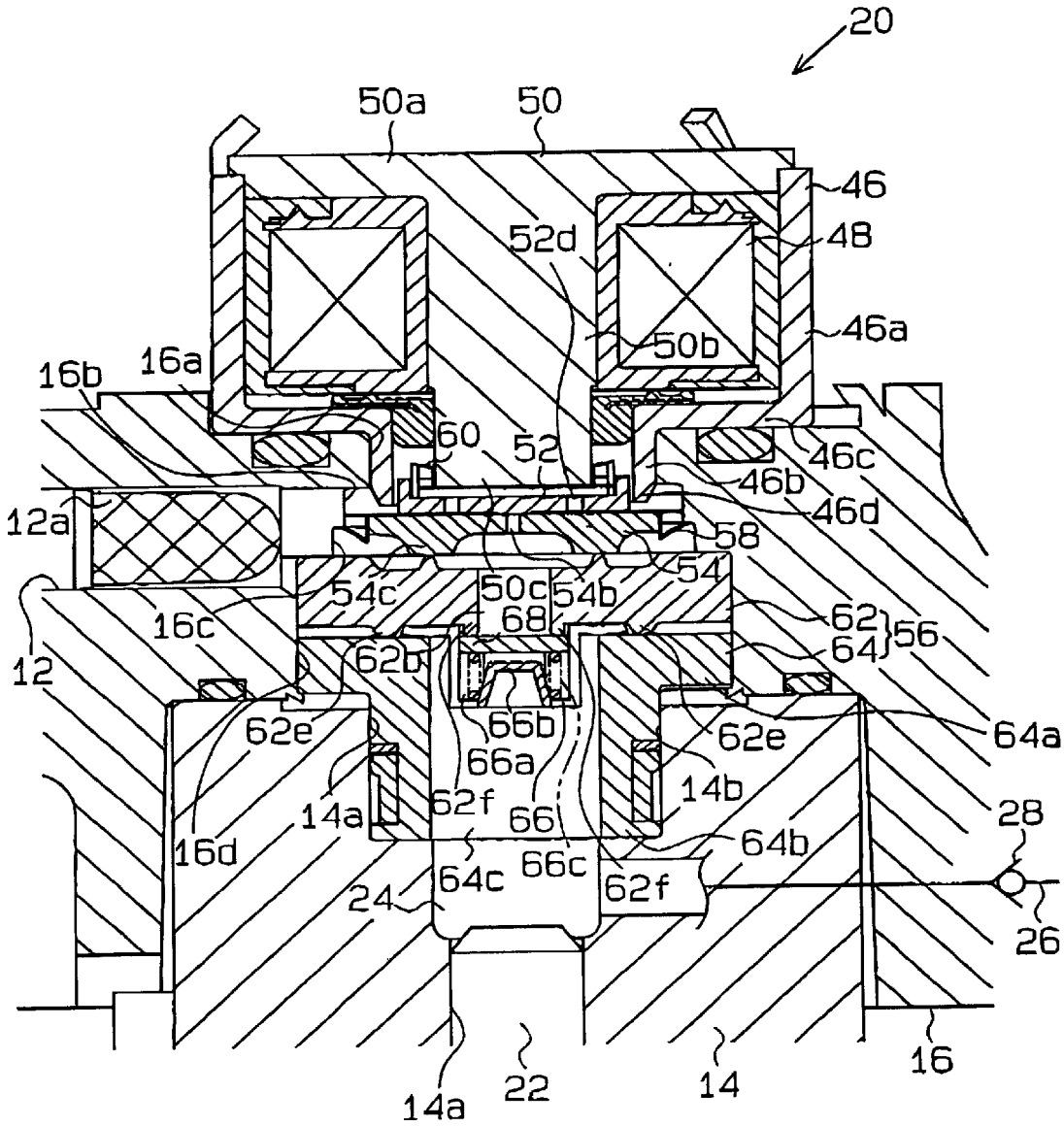
FIG. 2 is an enlarged cross-sectional view illustrating the electromagnetic fuel flow control valve of the pump shown in FIG. 1, which controls the flow of fuel supplied to an engine.
Figure 3A:
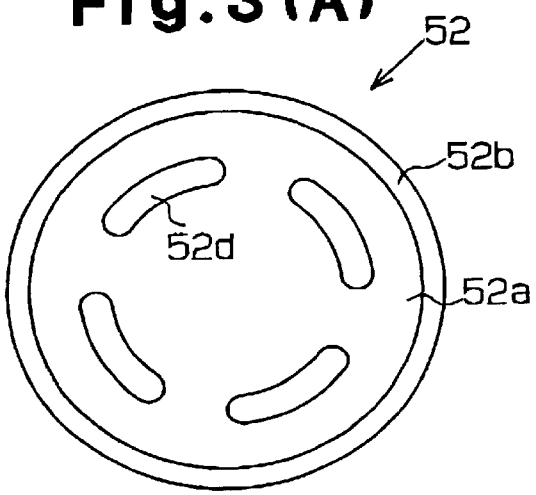
FIG. 3(A) is a plan view illustrating a sub-valve body used in the fuel flow control valve of FIG. 2.
Figure 3B:
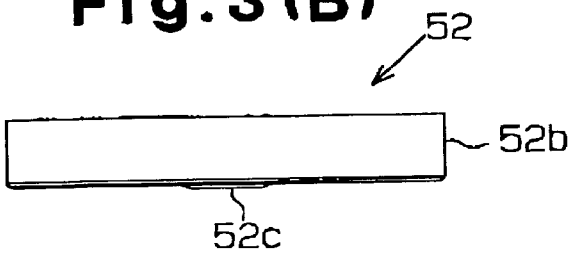
FIG. 3(B) is a side view illustrating the sub-valve body of FIG. 3(A)
Figure 3C:
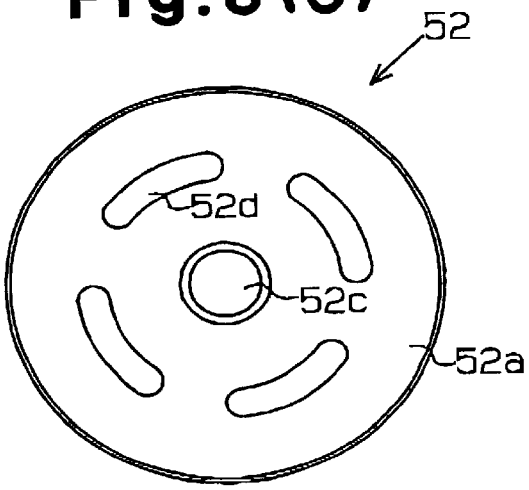
FIG. 3(C) is a bottom view illustrating the sub-valve body of FIG. 3(A)
Figure 3D:
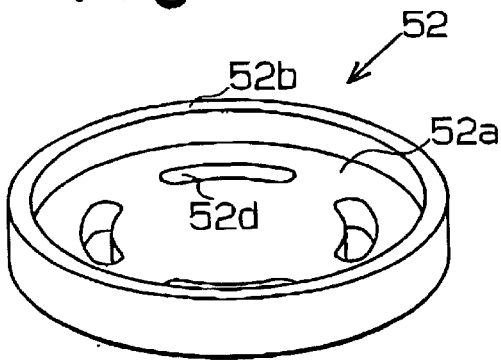
FIG. 3(D) is a top perspective view illustrating the sub-valve body of FIG. 3(A)
Figure 3E:
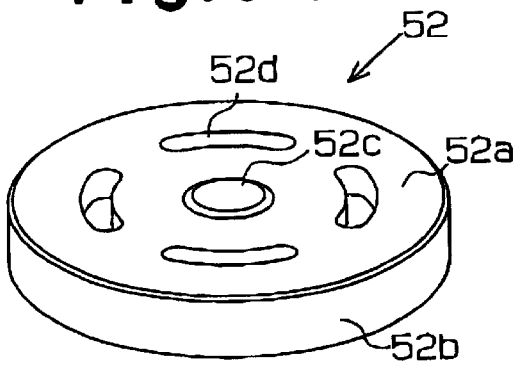
FIG. 3(E) is a bottom perspective view illustrating the sub-valve body of FIG. 3(A)
Figure 4A:
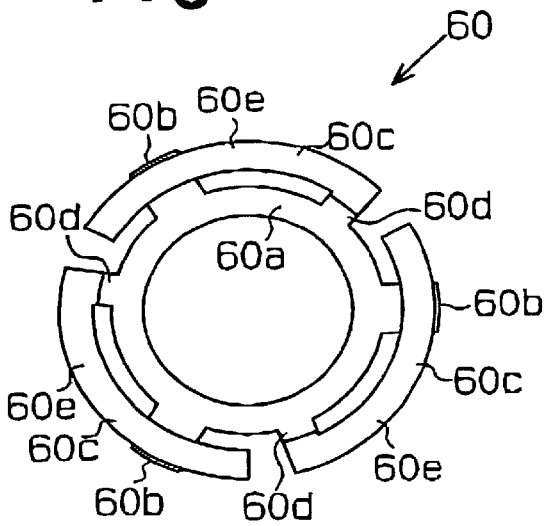
FIG. 4(A) is a plan view illustrating a second ring spring used in the fuel flow control valve of FIG. 2.
Figure 4B:
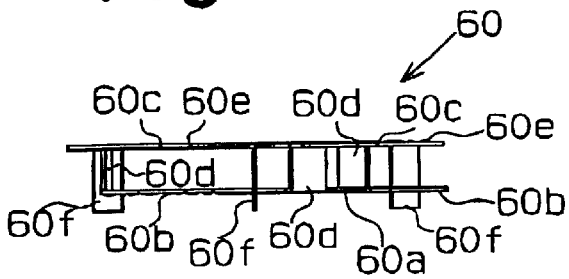
FIG. 4(B) is a side view illustrating the second ring spring of FIG. 4(A)
Figure 4C:
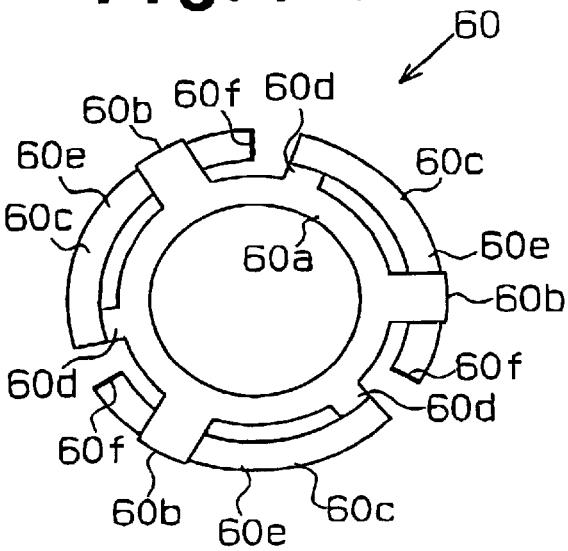
FIG. 4(C) is a bottom view illustrating the second ring spring of FIG. 4(A)
Figure 4D:
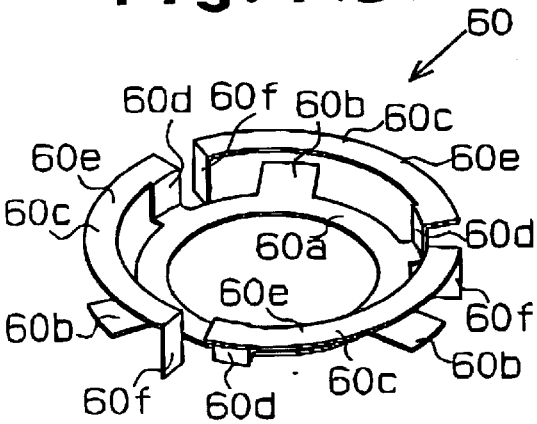
FIG. 4(D) is a top perspective view illustrating the second ring spring of FIG. 4(A)
Figure 4E:
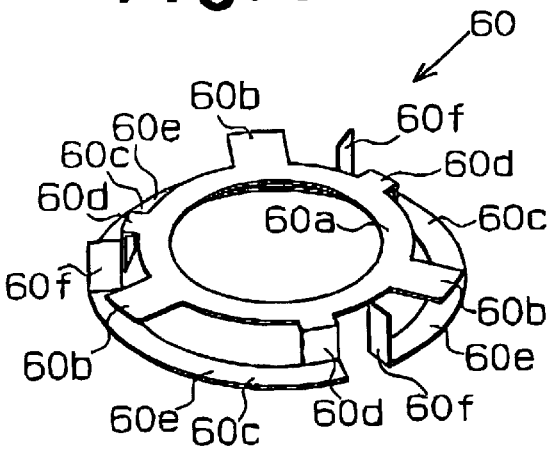
FIG. 4(E) is a bottom perspective view illustrating the second ring spring of FIG. 4(A)

The fuel flow control valve 20, the structure about the valve 20 and the function of the valve 20 will now be described with reference to FIG. 2. The fuel flow control valve 20 includes a cylindrical housing 46, an electromagnetic coil 48, a core 50, a sub-valve body 52, a disk shaped main valve body 54, and a seat body 56. The housing 46, the coil 48 and the core 50 function as means or a device for generating electromagnetic force. The housing 46 is made of a high permeable magnetic material and has a large diameter portion 46*a*, a small diameter portion 46*b* and a step 46*c*. The coil 48 is located inside the large diameter portion 46*a*. The core 50 includes a disk portion 50*a*, which is made of high permeable magnetic material, and a shaft portion 50*b*, which protrudes from the center of the disk portion 50*a*. The shaft portion 50*b* extends through the center of the coil 48. The disk portion 50*a* covers the upper end of the large diameter portion 46*a* of the housing 46. The housing 46 and the core 50 are secured to each other by crimping and the coil 48 is located between them. Therefore, the distal end 50*c* of the shaft portion 50*b* and the distal end 46*d* of the small diameter portion 46*b* project downward and are located close to each other. The distal ends 50*c*, 46*d* are fitted in a receiving hole 16*a* of the cover 16. In this state, the housing 46, the coil 48 and the core 50 are secured to the cover 16 by crimping.

A cylindrical small diameter chamber 16*b*, a cylindrical large diameter chamber 16*c* and a cylindrical seat body accommodation chamber 16*d* are formed in the cover 16. The chambers 16*b*, 16*c* and 16*d* are located below and coaxial with the receiving hole 16*a*. The diameters of the receiving hole 16*a*, the small diameter chamber 16*b*, the large diameter chamber 16*c* and the seat body accommodation chamber 16*d* increase in this order. The sub-valve body 52 is located inside the small diameter chamber 16*b*. The main valve body 54 is located inside the small diameter chamber 16*b* and the large diameter chamber 16*c*. The seat body 56 is located inside the seat body accommodation chamber 16*d*. A first ring spring 58 is engaged with a step that is defined between the small diameter chamber 16*b* and the large diameter chamber 16*c* and is located above the main valve body 54. A second ring spring 60 is located between the distal end 50*c* of the core 50 and the sub-valve body 52. The seat body 56 includes an upper seat member 62 and a lower seat member 64. The lower seat member 64 includes a disk portion 64*a* and a cylindrical portion 64*b*, which protrudes downward from the disk portion 64*a*. The cylindrical portion 64*b* is fitted into a recess 14*b*, which is formed in the cylinder body 14. The recess 14*b* and the pressurizing chamber 24 are formed continuously.

FIGS. 3(A) to 3(E) illustrate the shape of the sub-valve body 52. The sub-valve body 52 is made of a high permeable magnetic material and includes a disk portion 52*a* and a ring portion 52*b*. The ring portion 52*b* is located at the periphery of the disk portion 52*a*. An orifice sealing projection 52*c* is formed in the center of the lower surface of the disk portion 52*a*. The disk portion 52*a* has four arcuate openings 52*d* for adjusting flux saturation. The openings 52*d* are located about the sealing projection 52*c*.

FIGS. 4(A) to 4(E) illustrate the second ring spring 60, which is located between the sub-valve body 52 and the distal end 50*c* of the core 50. The second ring spring 60 includes a circular base 60*a*, three guide projections 60*b*, and three leaf portions 60*c*. The guide projections 60*b* project outward and are located at equal intervals. Each leaf portion 60*c* is located between an adjacent pair of the guide projections 60*b*. Each leaf portion 60*c* includes a support 60*d*, an arcuate section 60*e* and a contact section 60*f*. The support 60*d* of each leaf portion 60*c* is perpendicular to the base 60*a* and the guide projections 60*b*. The distal end of each support 60*d* is connected to the corresponding arcuate section 60*e*. Each arcuate section 60*e* extends from the corresponding support 60*d* along the base 60*a* and is parallel to the base 60*a* and the guide projections 60*b*. Each contact section 60*f* extends from the corresponding arcuate section 60*e* and is perpendicular to the base 60*a*. When the arcuate sections 60*e* are not flexed, the distal end of each contact section 60*f* extends beyond the base 60*a*.

Figure 5:
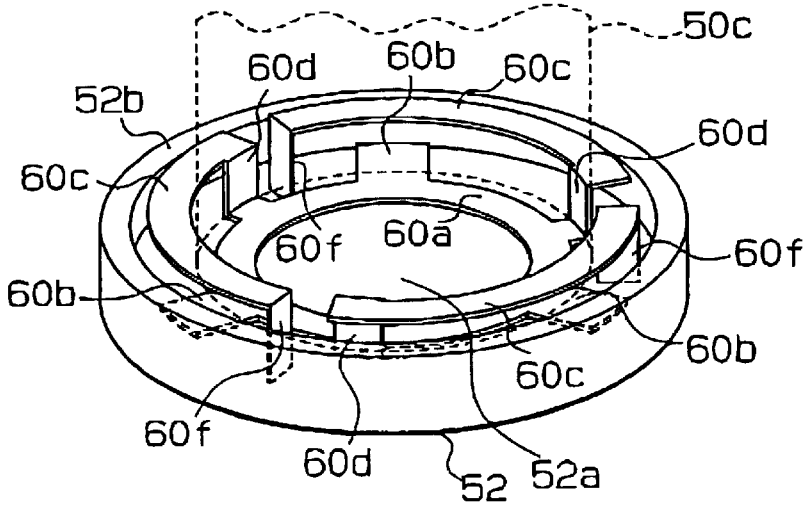
FIG. 5 is a perspective view illustrating the assembled state of the sub-valve body of FIG. 3(A) and the second ring spring of FIG. 4(A)
Figure 6A:
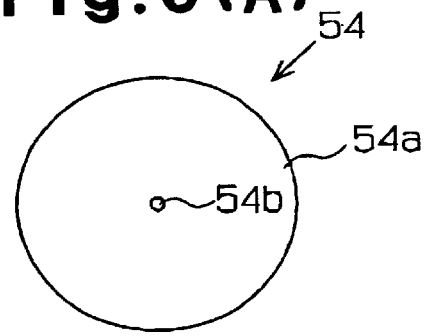
FIG. 6(A) is a plan view illustrating a main valve body used in the fuel flow control valve of FIG. 2.
Figure 6B:
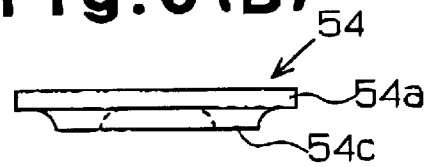
FIG. 6(B) is a side view illustrating the main valve body of FIG. 6(A)
Figure 6C:
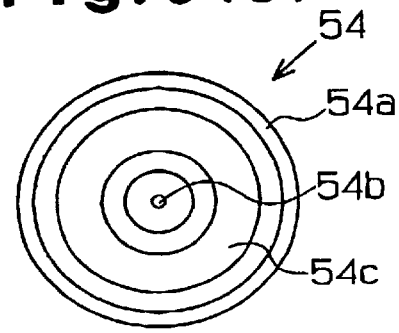
FIG. 6(C) is a bottom view illustrating the main valve body of FIG. 6(A)
Figure 6D:
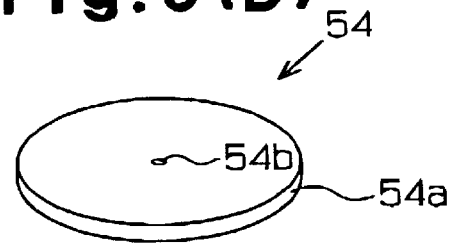
FIG. 6(D) is a top perspective view illustrating the main valve body of FIG. 6(A)
Figure 6E:
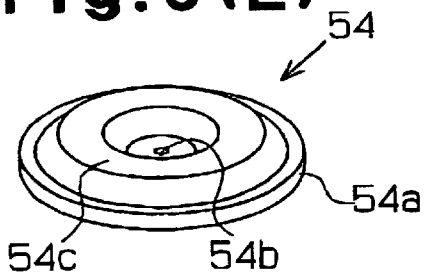
FIG. 6(E) is a bottom perspective view illustrating the main valve body of FIG. 6(A)

When the fuel flow control valve 20 is assembled, the distal end 50*c* of the core 50 is located in the space surrounded by the supports 60*d* and contacts the base 60*a* as shown by broken line in FIG. 5. In this state, the inner surface of each support 60*d* contacts the distal end 50*c*. The distal end 50*c*, together with the second ring spring 60, is located inside the space defined by the ring portion 52*b* of the sub-valve body 52. The distal end of each guide projection 60*b* contacts the inner surface of the ring portion 52*b* so that the sub-valve body 52 moves only in the axial direction. As shown in FIG. 2, the sub-valve body 52 is located in the small diameter chamber 16*b* and pressed through the main valve body 54, which moves the contact sections 60*f* upward and flexes the arcuate sections 60*c*. Accordingly, the second ring spring 60 urges the sub-valve body 52 toward the main valve body 54.

FIGS. 6(A) to 6(E) illustrate the shape of the main valve body 54. The main valve body 54 is made of a high permeable magnetic material. The diameter of the main valve body 54 is greater than that of the sub-valve body 52. The main valve body 54 includes a flat main portion 54*a*. An orifice 54*b* is formed through the center of the main portion 54*a*. The main valve body 54 also includes a seal portion 54*c*, which protrudes from the lower surface of the valve body 54 and surrounds the lower opening of the orifice 54*b*.

Figure 7A:
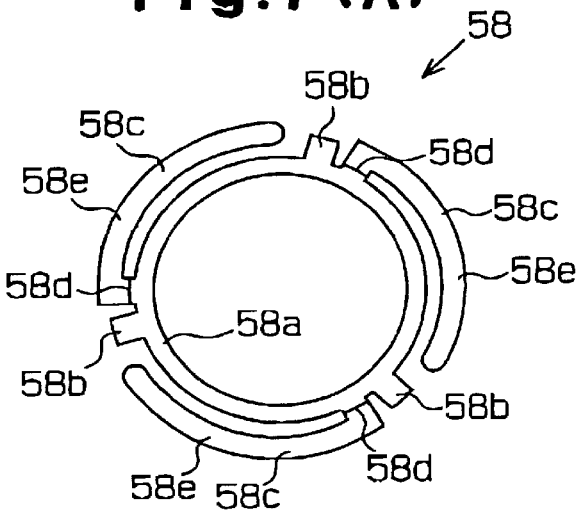
FIG. 7(A) is a plan view illustrating a first ring spring used in the fuel flow control valve of FIG. 2.
Figure 7B:
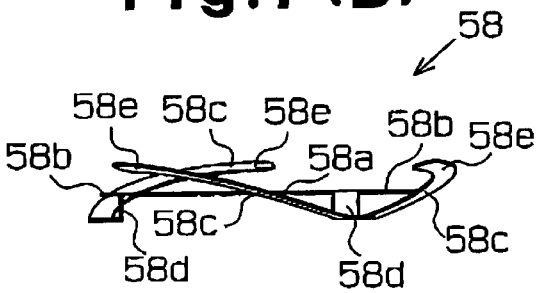
FIG. 7(B) is a side view illustrating the first ring spring of FIG. 7(A)
Figure 7C:
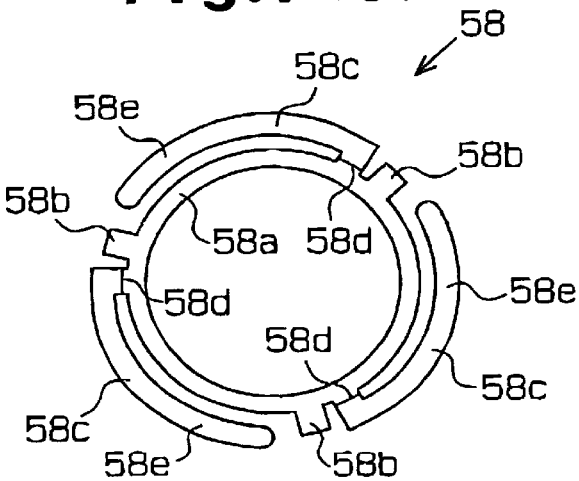
FIG. 7(C) is a bottom view illustrating the first ring spring of FIG. 7(A)
Figure 7D:
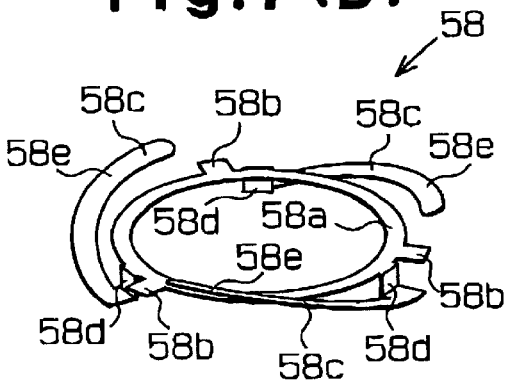
FIG. 7(D) is a top perspective view illustrating the first ring spring of FIG. 7(A)
Figure 7E:
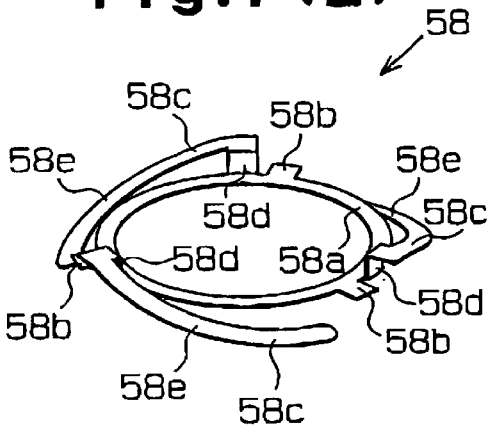
FIG. 7(E) is a bottom perspective view illustrating the first ring spring of FIG. 7(A)
Figure 8:
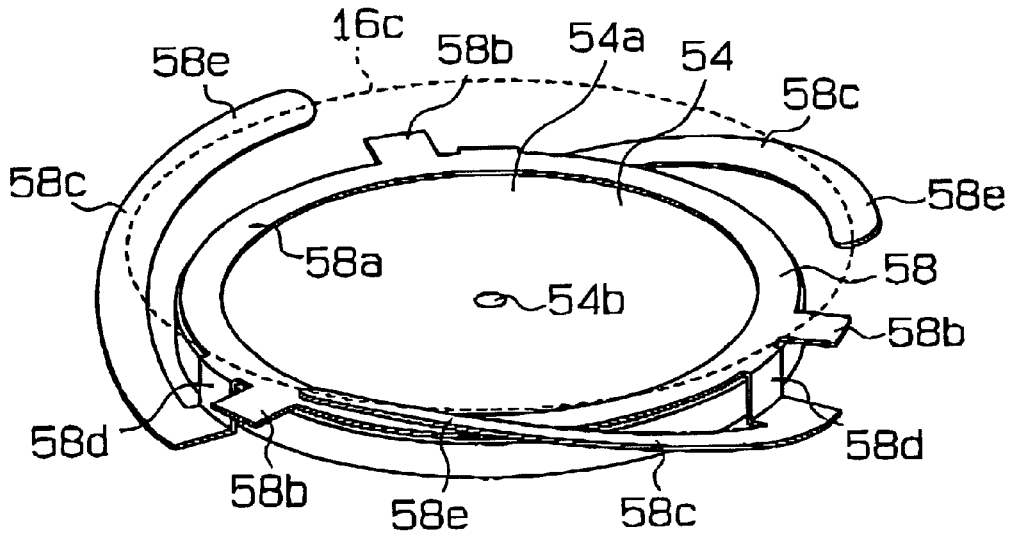
FIG. 8 is a perspective view illustrating the assembled state of the main valve body of FIG. 6(A) and the first ring spring of FIG. 7(A)

FIGS. 7(A) to 7(E) illustrate the first ring spring 58, which is located above the main valve body 54. The first ring spring 58 includes a circular base 58*a*, three guide projections 58*b* and three leaf portions 58*c*. The guide projections 58*b* project outward from the base 58*a* and are spaced apart by equal intervals. Each leaf portion 58*c* includes a support 58*d* and an arcuate section 58*e*. Each support 58*d* extends perpendicular to the base 58*a* and the guide projections 58*b*. The distal end of each support 58*d* is connected to the corresponding arcuate section 58*e*. Each arcuate section 58*e* extends along the base 58*a*. Also, each arcuate section 58*e* is inclined toward the plane that includes the base 58*a* from the distal end of the corresponding support 58*d* along the base 58*a*. When the arcuate sections 58*e* are not flexed, the distal end of each arcuate section 58*e* is located at the opposite side of the base 58*a* to the proximal ends of the sections 58*e* as shown in FIG. 7(B).

When the fuel flow control valve 20 is assembled, the main portion 54*a* of the main valve body 54 is located in the space surrounded by the supports 58*d* and contacts the base 58*a*. The inner surface of each support 58*d* contacts the outer surface of the main portion 54*a*. The main valve body 54, together with the first ring spring 58, is located inside the small diameter chamber 16*b* and the large diameter chamber 16*c*. The guide projections 58*b* of the first ring spring 58 contact the inner surface of the small diameter chamber 16*b* so that the main valve body 54 moves only in the axial direction. The arcuate sections 58*e* are engaged with the step defined by the small diameter chamber 16*b* and the large diameter chamber 16*c*. The arcuate sections 58*e* are flexed and urge the main valve body 54 toward the upper seat member 62.

Figure 9:
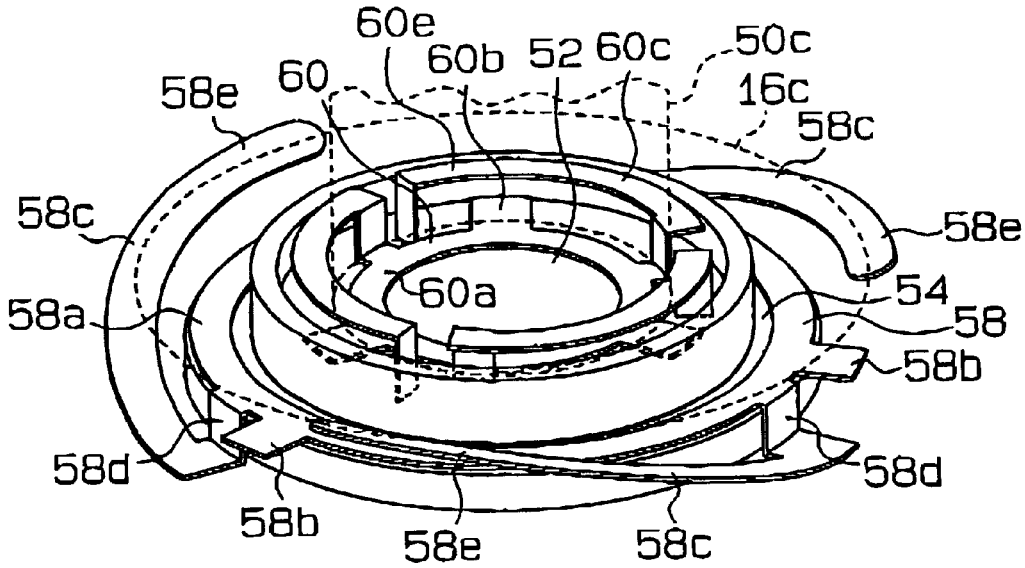
FIG. 9 is a perspective view illustrating the assembled state of the sub-valve body of FIG. 3(A), the second ring spring of FIG. 4(A), the main valve body of FIG. 6(A) and the first ring spring of FIG. 7(A)
Figure 10:
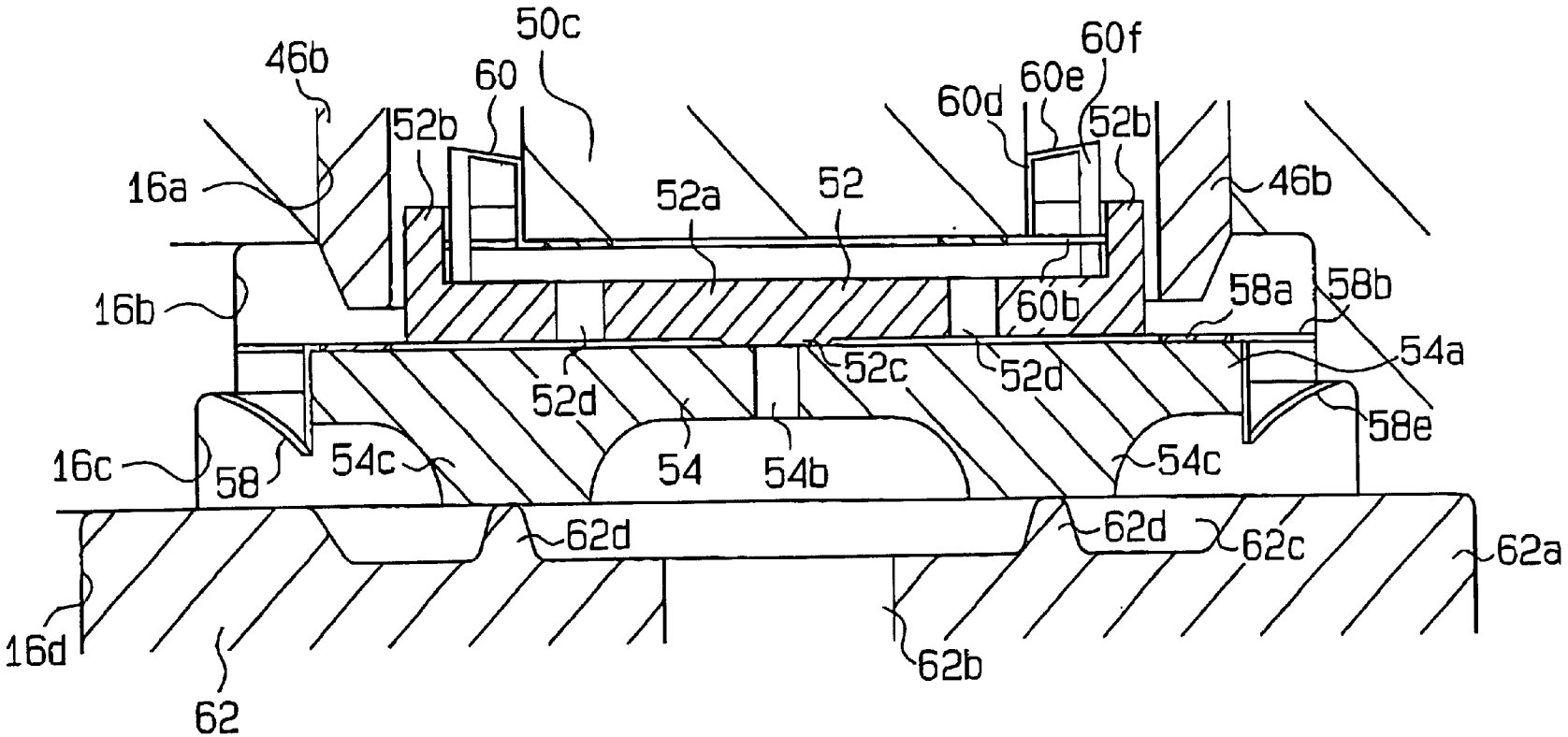
FIG. 10 is a cross-sectional view illustrating the sub-valve body of FIG. 3(A), the second ring spring of FIG. 4(A), the main valve body of FIG. 6(A) and the first ring spring of FIG. 7(A), which are installed in the fuel flow control valve of FIG. 2.
Figure 11:
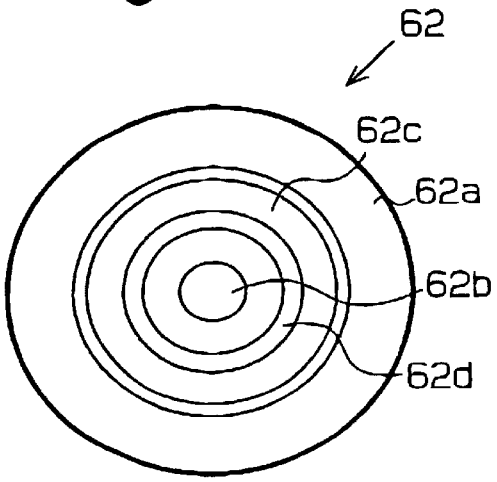
FIG. 11(A) is a plan view illustrating an upper seat body used in the fuel flow control valve of FIG. 2.
FIG. 11(B) is a side view illustrating the upper seat body of FIG. 11(A)
FIG. 11(C) is a bottom view illustrating the upper seat body of FIG. 11(A)
FIG. 11(D) is a top perspective view illustrating the upper seat body of FIG. 11(A)
FIG. 11(E) is a bottom perspective view illustrating the upper seat body of FIG. 11(A)
Figure 11:
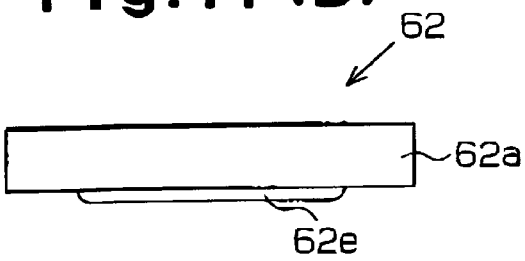
Figure 11:
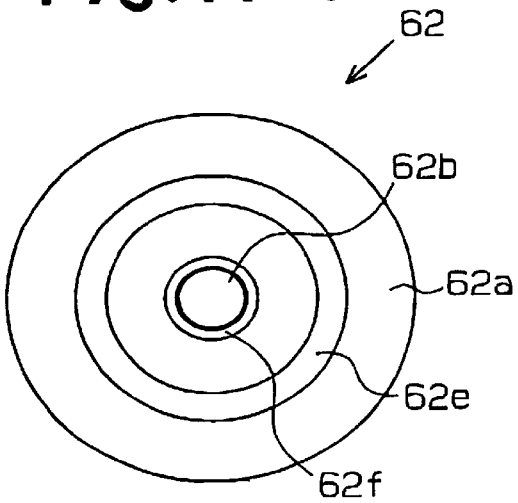
Figure 11:
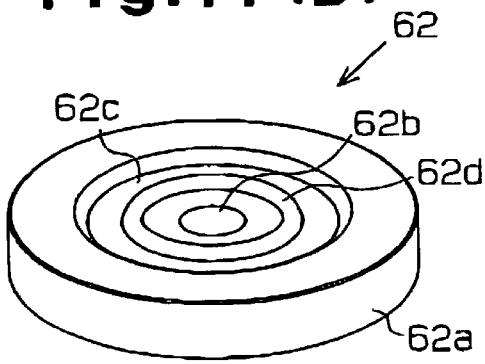
Figure 11:
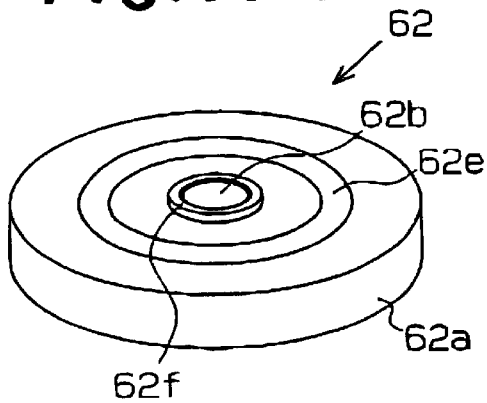
Figure 12A:
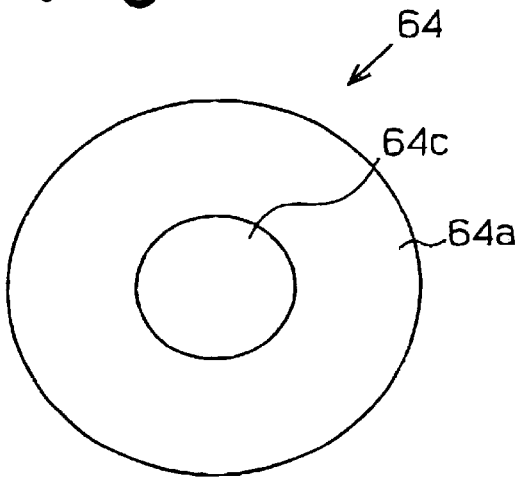
FIG. 12(A) is a plan view illustrating a lower seat body used in the fuel flow control valve of FIG. 2.
Figure 12B:
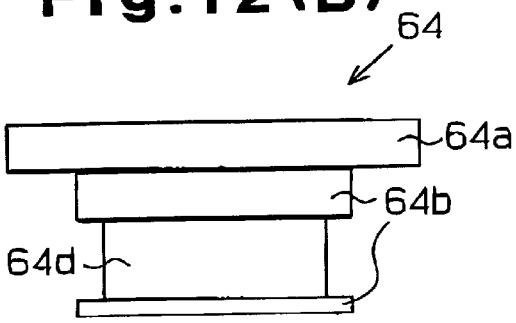
FIG. 12(B) is a side view illustrating the lower seat body of FIG. 12(A)
Figure 12C:
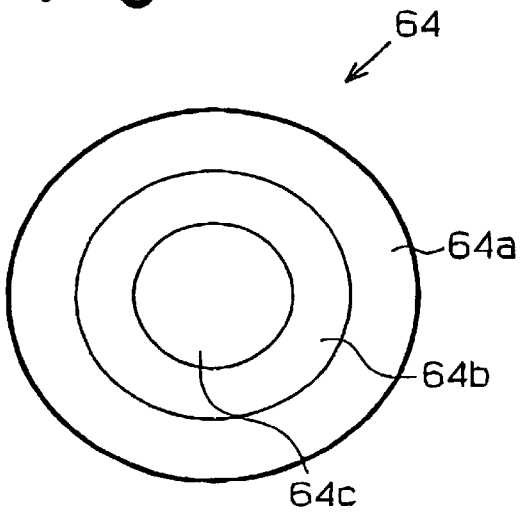
FIG. 12(C) is a bottom view illustrating the lower seat body of FIG. 12(A)
Figure 12D:
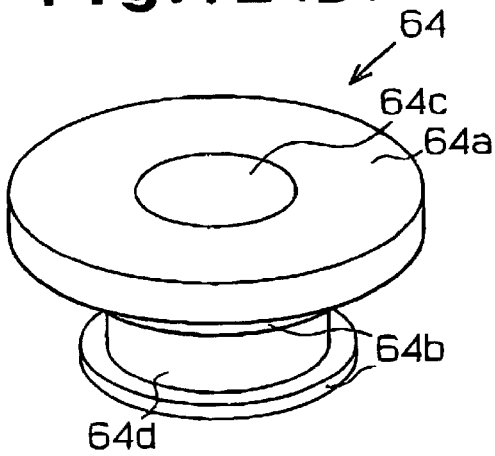
FIG. 12(D) is a top perspective view illustrating the lower seat body of FIG. 12(A)
Figure 12E:
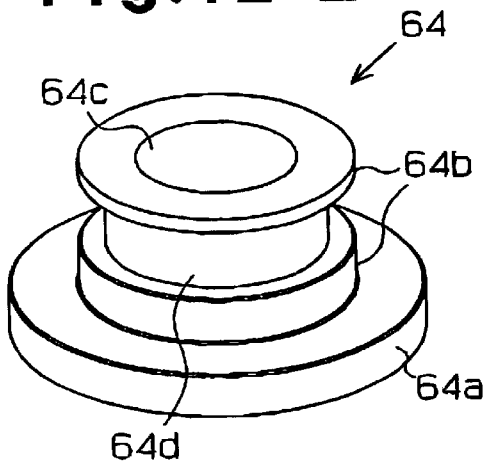
FIG. 12(E) is a bottom perspective view illustrating the lower seat body of FIG. 12(A)

In the cover 16, the main valve body 54 and the sub-valve body 52 are stacked as shown in FIG. 9. In this state, the orifice 54*b* of the main portion 54*a*, is covered by the sealing projection 52*c* of the sub-valve body 52 as shown in FIG. 10. In FIGS. 1, 2, 10, 13, 14 and 15, the first ring spring 58 and the second ring spring 60 are simplified for purposes of illustration.

FIGS. 11(A) to 11(E) illustrate the upper seat member 62. The upper seat member 62 is made of a nonmagnetic material and includes a disk portion 62*a*. A supply hole 62*b* is formed in the center of the disk portion 62*a*. An annular recess 62*c* is formed on the upper surface of the disk portion 62*a*. A seat 62*d* is formed on the upper surface inside the recess 62*c*. An annular sealing projection 62*e* is formed on the lower surface of the disk portion 62*a* about the lower opening of the supply hole 62*b*. A check valve seat 62*f* is formed at the lower opening of the supply hole 62*b*. As shown in FIG. 10, the seal 54*c* of the main valve body 54 is pressed against the seat 62*d* by the first ring spring 58. The sealing projection 62*e* contacts the upper surface of the lower seat member 64.

FIGS. 12(A) to 12(E) illustrate the lower seat member 64. The lower seat member 64 is made of nonmagnetic material. The lower seat member 64 includes a disk shaped base 64*a* and a cylindrical portion 64*b*, which is located at the lower side of the base 64*a*. A cylindrical space 64*c* is defined inside the base 64*a* and the cylindrical portion 64*b*. The cylindrical space 64*c* forms a part of the pressurizing chamber 24. An annular seal recess 64*d* is formed in the outer surface of the cylindrical portion 64*b*. As described above, the upper surface of the base 64*a* contacts the sealing projection 62*e* of the upper seat member 62. As shown in FIG. 2, a cup-shaped valve body holder 66 is located between the upper seat member 62 and the lower seal member 64. Specifically, the flange of the valve body holder 66 is held by the upper and lower seat members 62 and 64. The valve body holder 66 surrounds the lower opening of the supply hole 62*b* of the upper seat member 62. A disk-shaped check valve body 68 is accommodated in a space 66*a*, which is defined in the valve body holder 66. The check valve body 68 is urged toward the lower opening of the supply hole 62*b* by a sprig 66*c*. Therefore, when the pressure in the pressurizing chamber 24 is higher than the pressure in the supply hole 62*b*, the check valve body 68 contacts the check valve seat 62*f* of the upper seat member 62 and prevents fuel from flowing from the pressurizing chamber 24 to the supply hole 62*b*. A stopper 66*b* is formed in the center of the valve body holder 66 and projects into the space 66*a*. When the pressure in the supply hole 62*b* is higher than the pressure in the pressurizing chamber 24, the check valve body 68 separates from the check valve seat 62*f*. At this time, the stopper 66*b* limits the distance between the check valve body 68 and the check valve seat 62*f*.

Since the fuel flow control valve 20 is located between the supply passage 12 and the pressurizing chamber 24, the amount of fuel supplied to the pressurizing chamber 24 is controlled by adjusting the valve opening period of the sub-valve body 52 and the main valve body 54.

The sub-valve body 52 is closer to the distal end 46*d* of the housing 46 and the distal end 50*c* of the core 50 than the main valve body 54. The main valve body 54 is stacked on the sub-valve body 52. Therefore, the magnetic circuit based on the electromagnetic force generated by the coil 48 lies along the radial direction between the central and peripheral sections of the sub-valve body 52 and the main valve body 54. Thus, the sub-valve body 52 and the main valve body 54 are attracted toward the core 50 by the electromagnetic force.

The electromagnetic force that acts on the sub-valve body 52 and the main valve body 54 is determined by adjusting the arrangement of the sub-valve body 52 and the main valve body 54, and by changing the degree of flux saturation. The degree of flux saturation is adjusted by changing the size, the shape and the arrangement of the arcuate openings 52*d*. The first ring spring 58 urges the main valve body 54, and the second ring spring 60 urges the sub-valve body 52. The relationship between the electromagnetic force and the force of the springs 58, 60 is determined such that the sub-valve body 52 can be moved without moving the main valve body 53 by controlling the electromagnetic force of the coil 48. In other words, the position of the sub-valve body 52 can be changed for opening the orifice 54*b* without changing the position of the main valve body 54. Further, the period from when the sub-valve body 52 opens the orifice 54*b* to when the main valve body 54 opens the supply hole 62*b* can be controlled.

When the engine 4 is running, the fuel flow control valve 20 is controlled by an electronic control unit (ECU) 70 in the following manner. The ECU 70 receives data from various sensors. The data includes the engine speed, the crank angle, the intake pressure, the coolant temperature, the acceleration pedal depression degree, the throttle opening degree, the oxygen concentration of the exhaust gas, and the fuel pressure in the distribution pipe 30. The fuel pressure is detected by a fuel pressure sensor 30*a*, which is located in the distribution pipe 30. Based on the received data, the ECU 70 controls the level and timing of the current supplied to the coil 48. The ECU 70 also controls the injection timing and the length of the injection period of the fuel injectors 6.

Figure 13A:
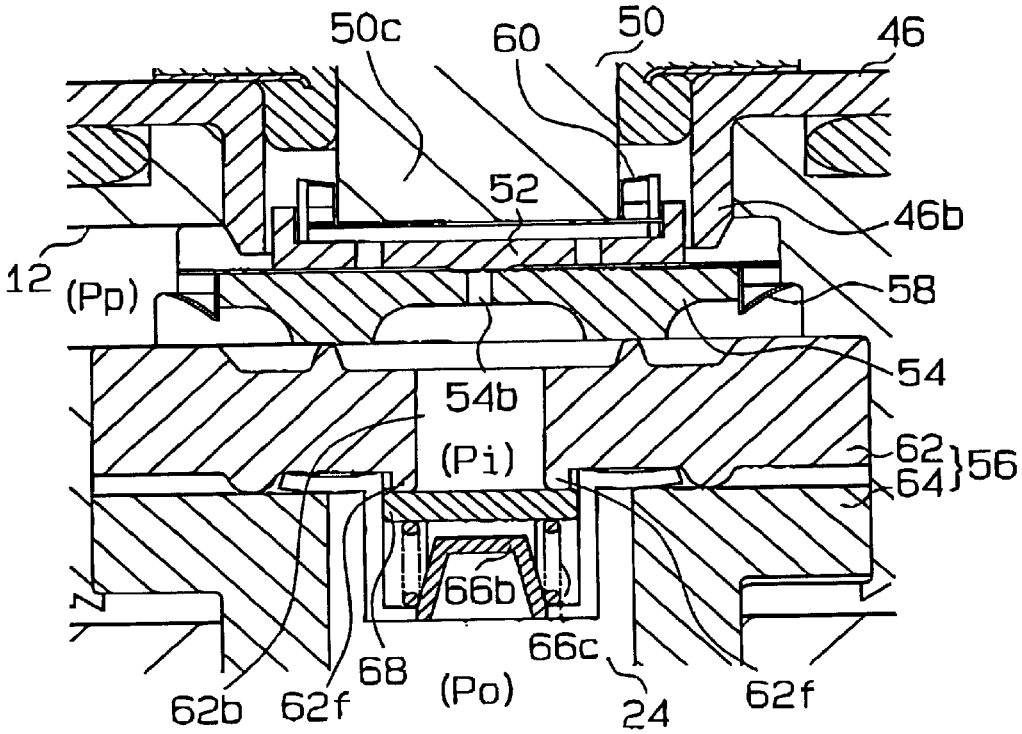
FIGS. 13(A) and 13(B) are cross-sectional views illustrating the operation of the fuel flow control valve shown in FIG. 2.

When the engine 4 is running, the cam noses 44*a* are consecutively raised as the cam 44 rotates, which lifts the plunger 22 and initiates compression stroke. During compression stroke, if the pressurizing chamber 24 is not filled with liquid fuel, the pressure Po in the pressurizing chamber 24 is maintained close to the fuel vapor pressure until the volume of the pressurizing chamber 24 is decreased to the volume of the liquid fuel as the plunger 22 is raised. In this state, no current is supplied to the coil 48, and the sub-valve body 52 and the main valve body 54 are closed as shown in FIG. 13(A). At this time, the check valve body 68 is contacting the check valve seat 62*f* since the pressure Po in the pressurizing chamber 24 is close to the fuel vapor pressure. Thus, the pressure Pi in the supply hole 62*b* is substantially as low as the pressure Po. The pressure Pi in the supply hole 62*b* is lower than the pressure Pp in the fuel supply passage 12, to which fuel is sent by the feed pump 8.

When the volume of the-pressurizing chamber 24 is equal to the volume of the liquid fuel in the chamber 24, fuel in the chamber 24 starts being pressurized. Thereafter, the fuel pressure Po in the pressurizing chamber 24 is rapidly increased. Then, the fuel pushes open the discharge check valve 28 and flows to the distribution pipe 30. At this time, the pressure Pi in the supply hole 62*b* is lower than the fuel pressure Pp in the fuel supply passage 12.

Figure 13B:
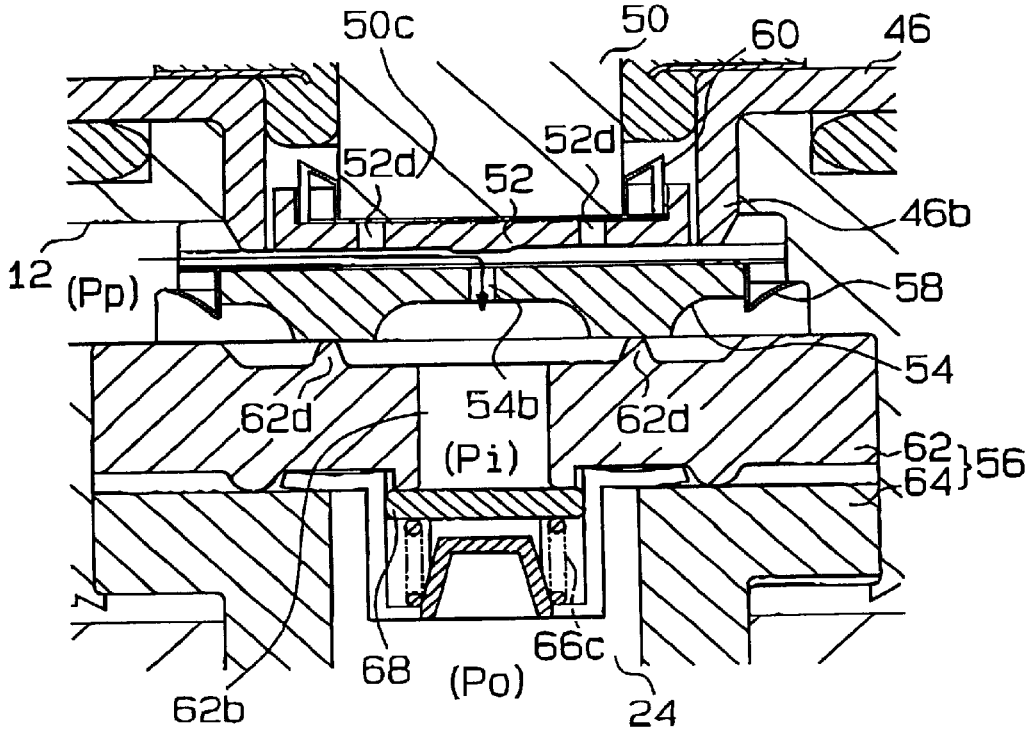

When the plunger 22 substantially reaches the top dead center, the ECU 70 controls the current to the coil 48 to generate electromagnetic force, which causes the sub-valve body 52 to open the orifice 54*b*. Accordingly, the sub-valve body 52 is attracted to the core 50 against the force of the second ring spring 60 and contacts the distal end 50*c* of the core 50. The sub-valve body 52 opens the orifice 54*b* as shown in FIG. 13(B), which equalizes the pressure Pi in the supply hole 62*b* with the pressure Pp in the fuel supply passage 12. Until the orifice 54*b* is opened, the main valve body 54 is pressed against the seat 62*d* by a force based on the difference (Pp−Pi) of the pressure Pp in the fuel supply passage 12 and the pressure Pi in the supply hole 62*b*, which is lower than the pressure Pp. When the sub-valve body 52 opens the orifice 5*d*b, the pressure difference (Pp−Pi) is eliminated.

Figure 14A:
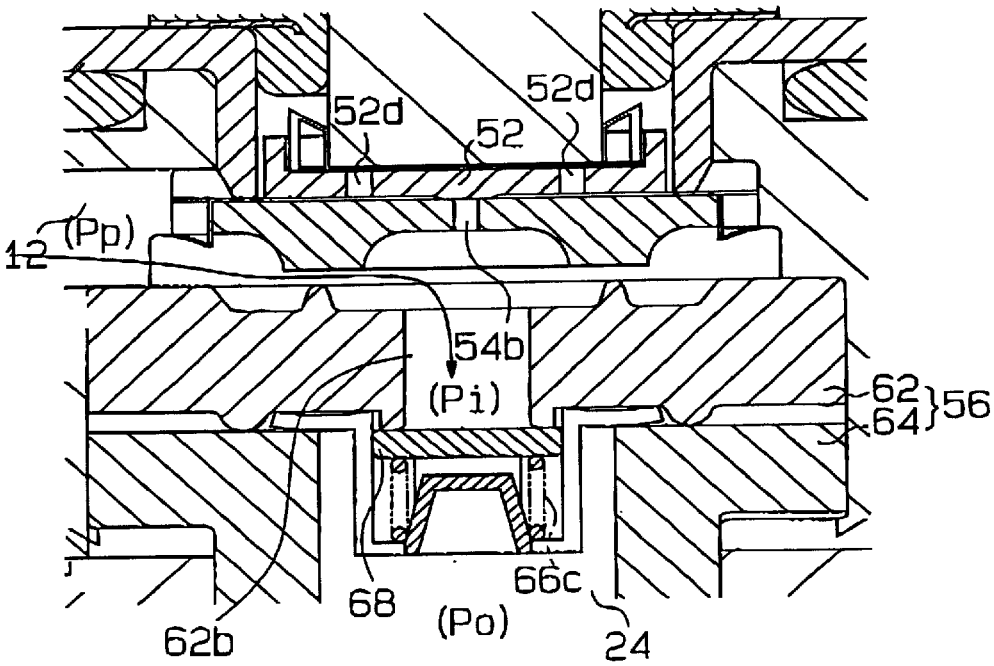
FIGS. 14(A) and 14(B) are cross-sectional views illustrating the operation of the fuel flow control valve shown in FIG. 2.

Then, the level of the current to the coil 48 is increased to saturate the flux at the sub-valve body 52, which rapidly increase the flux density at the main valve body 54. Accordingly, the electromagnetic force is increased and the main valve body 54 opens the supply hole 62*b* as shown in FIG. 14(A). At this time, since the sub-valve body 52 has opened the orifice 54*b*, the force that urges the main valve body 54 against the seat 62*d* based on the pressure difference (Pp−Pi) has been eliminated. Therefore, even if the current level is increased by a small degree, the main valve body 54 is quickly opened against the force of the first ring spring 58, which permits fuel to flow from the fuel supply passage 12 to the supply hole 62*b*.

Figure 14B:
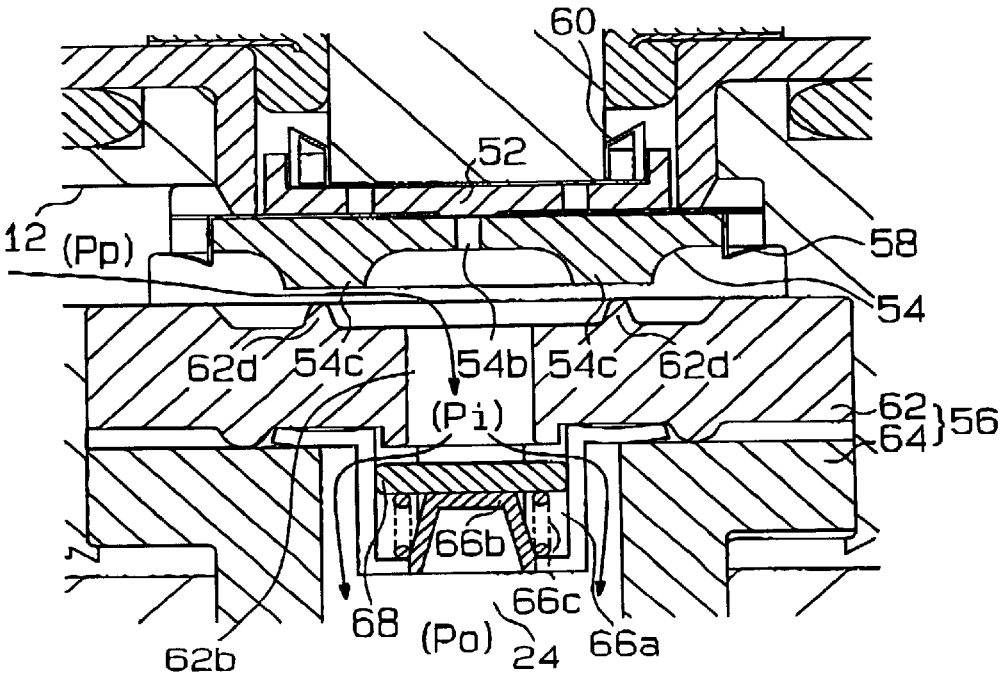

When the plunger 22 is lowered, the pressure Po in the pressurizing chamber 24 falls below the pressure Pi in the supply hole 62*b*, which opens the check valve body 68 as shown in FIG. 14(B). Accordingly, fuel is drawn into the pressurizing chamber 24 from the fuel supply passage 12 through the seal 54*c* of the main valve body 54 and the seat 62*d* of the upper seat member 62.

Then, the ECU 70 judges that the amount of fuel that has been drawn into the pressurizing chamber 24 is sufficient for a single injection based on data such as the crank angle. Thereafter, the ECU 70 completely stops the current to the coil 48 so that the main valve body 54 and the sub-valve body 52 are returned to the initial positions by the force of the first ring spring 58 and the force of the second ring spring 60. The main valve body 54 contacts the seat 62*d* of the upper seat member 62, and the sealing projection 52*c* of the sub-valve body 52 closes the orifice 54*b* of the main valve body 54. Therefore, the fuel supply from the fuel supply passage 12 to the pressurizing chamber 24 is stopped. As the cam noses 44*a* move, the plunger 22 is lowered by the force of the spring 42 until the volume of the pressurizing chamber 24 is maximized. Since the fuel supply is stopped, the pressurizing chamber 24 is filled with liquid fuel and fuel vapor. The volume of the fuel vapor is equal to the difference between the current volume of the pressurizing chamber 24 and the volume of liquid fuel in the pressurizing chamber 24.

When the plunger 22 is again lifted by the movement of the cam noses 44*a*, the fuel flow control valve 20 returns to the state of FIG. 13(A).

The fuel flow control valve 20 repeats the procedure illustrated in FIGS. 13(A) to 14(B). The amount of fuel drawn into the pressurizing chamber 24 is adjusted by controlling the opening period of the main valve body 54. Accordingly, the amount of fuel supplied to the distribution pipe 30 is determined.

Further, when the load on the engine 4 is small, such as when the engine 4 is idling, the injection amount from the injectors 6 is very small. At this time, the main valve body 54 closes the supply hole 62*b*, and only the sub-valve body 52 opens and closes the orifice 54*b*.

A control procedure for controlling the flow rate of fuel supplied from the high pressure fuel pump 2 to the distribution pipe 30 will now be described with reference to the flowchart of FIG. 15. The routine of FIG. 15 is executed at predetermined crank angle increments.

Figure 15:
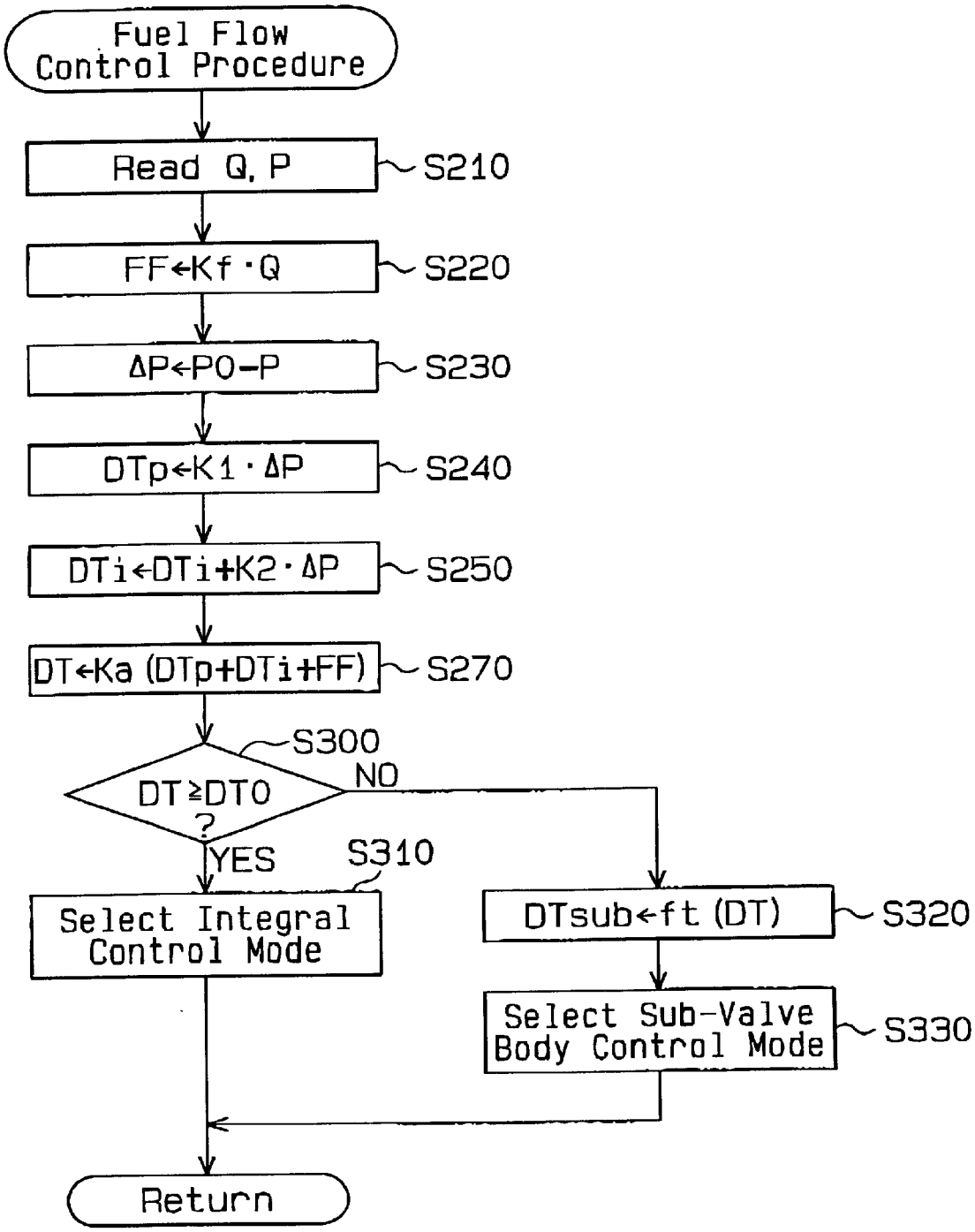
FIG. 15 is a flowchart showing a procedure for controlling the flow rate of fuel supplied to an engine.

When the routine of FIG. 15 is started, the fuel injection amount Q and the fuel pressure P in the distribution pipe 30 are stored in a working area of a RAM in step S210. The pressure P has been detected by the fuel pressure sensor 30*a*, which is located in the distribution pipe 30.

Then, the fuel amount Q is multiplied by a feed forward factor Kf for computing a feed forward term FF at step S220. Thereafter, a pressure difference ΔP between a target fuel pressure P0 and the actual fuel pressure P is calculated by using the following equation (1) in step S230.

$$\Delta P = P0 - P \tag{1}$$

The, the pressure difference ΔP is multiplied by a proportional coefficient K1 to compute a proportionality term DTp in step S240. Further, based on the equation (2), an integration term DTi is computed based on the product (K2·ΔP) of the pressure difference ΔP and an integration coefficient K2 in step S250.

$$Dti = DTi + K2\Delta P \tag{2}$$

The value DTi in the right side of the equation represents the integration term DTi that was computed in the previous control cycle. The initial value of the term DTi is, for example, zero.

Then, a control duty ratio DT is computed by the equation (3) in step S270. The control duty ratio DT is used for determining the opening period (the intake period) of the fuel flow control valve 20, or the period during which fuel is drawn into the valve 20.

$$DT = Ka(DTp + DTi + FF) \tag{3}$$

Ka represents a correction factor.

In step S300, the ECU 70 judges whether the duty ratio DT, which is computed in step S270, is greater than a determination value DT0. The determination value DT0 is used for judging whether the duty ratio DT is relatively small and therefore the period from when the sub-valve body 52 is opened to when the main valve body 54 is opened is relatively short. That is, the determination value DT0 is used for judging whether the current duty ratio DT is in a range at which accurate control of response of the valve 20 is difficult. For example, the determination value DT0 is set to 5%.

Figure 16:
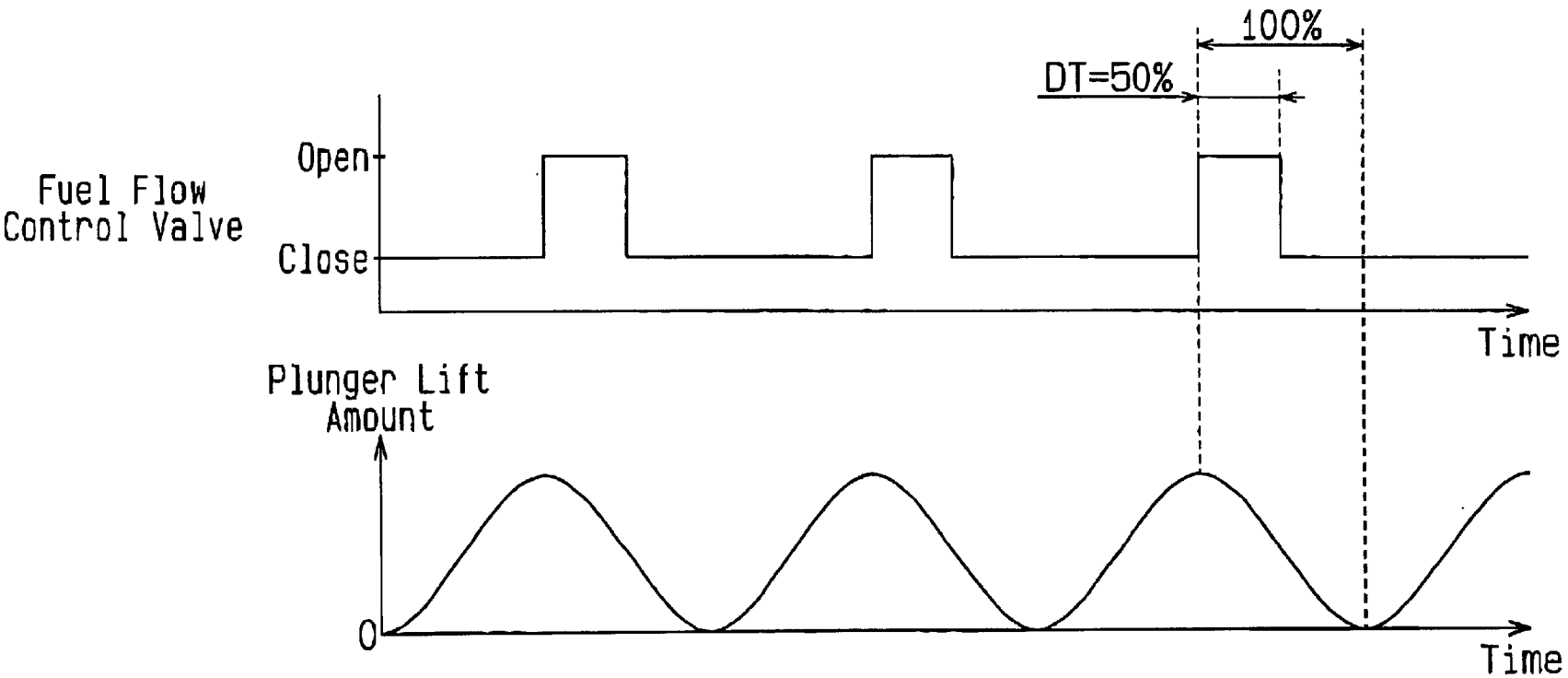
FIG. 16 is a timing chart showing a control procedure of the first embodiment.

If the duty ratio DT is equal to or greater than the determination value DT0 (DT≧DT), that is, if the outcome of step S300 is positive, the sub-valve body 52 and the main valve body 54 can be accurately controlled if both valve bodies 52, 54 are controlled. In this case, an integral control mode is selected in step S310. Thereafter, the ECU 70 temporarily suspends the current routine. Therefore, if the duty ratio DT is 50% as shown in FIG. 16, the integral control mode is selected. In the integral control mode, the sub-valve body 52 is actuated to open the orifice 54*b* of the main valve body 54 immediately before the plunger 22 reaches the top dead center. Accordingly, the force based on the pressure difference acting on the main valve body 54 is eliminated. Then, the main valve body 54 is actuated to open the supply hole 62*b*. The main valve body 54 and the sub-valve body 52 close the orifice 54*b* and the supply hole 62*b* for a time that corresponds to the duty ratio DT. Accordingly, the required amount of fuel is drawn into the pressurizing chamber 24 during the intake stroke. During compression stroke, fuel, the amount of which is equal to the amount of the drawn fuel, is discharged to the distribution pipe 30.

Figure 17A:
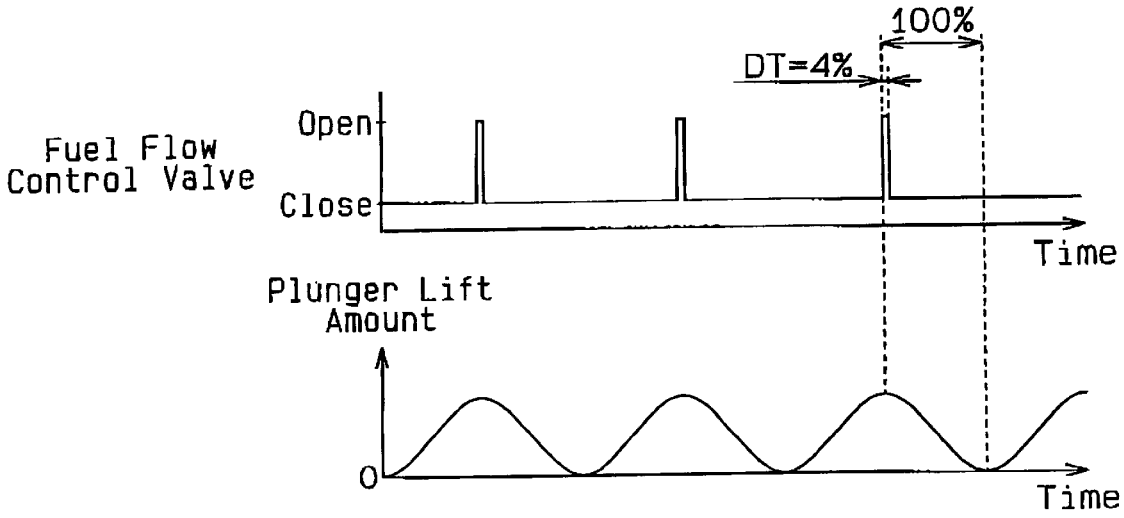
FIG. 17(A) is a timing chart showing a control procedure of the first embodiment.
Figure 17B:
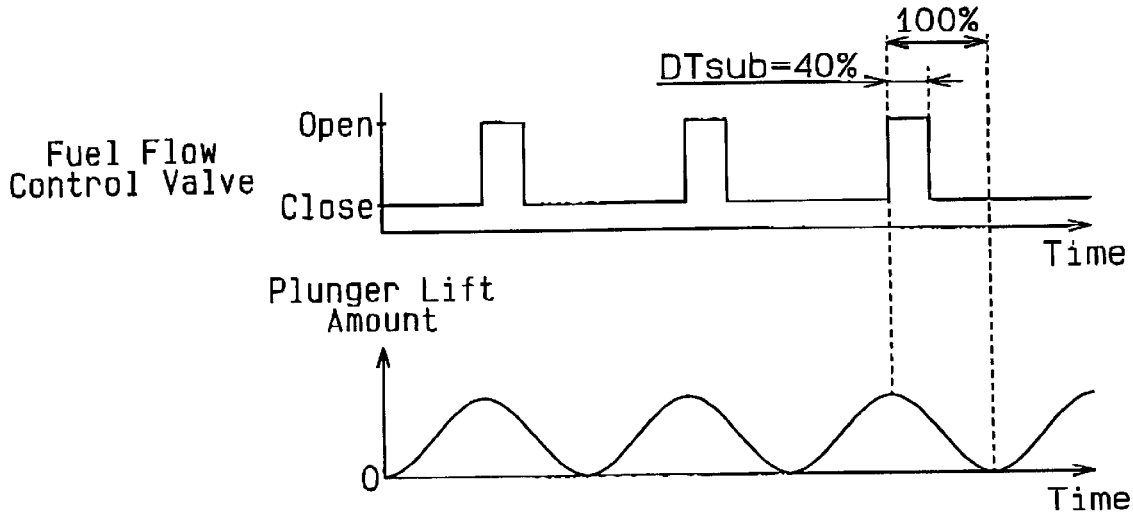
FIG. 17(B) is a timing chart showing another control procedure of the first embodiment.

If the duty ratio Dt is less than the determination value DT0, or if the outcome of step S300 is negative, the duty ratio DT is not high enough to accurately control the sub-valve body 52 and the main valve body 54. In this case, the duty ratio DT is converted into a sub-valve body duty ratio DTsub by using a function or a map in step S320. The sub-valve body duty ratio DTsub is used when only the sub-valve body 52 is actuated. Then, a sub-valve body control mode is selected in step S330. Thereafter, the ECU 70 temporarily suspends the current routine. For example, when the duty ratio for actuating the main valve body 54 and the sub-valve body 52 is 4% as shown in FIG. 17(A), the ECU 70 judges that the duty ratio Dt is too low to control the both main valve body 54 and the sub-valve body 52 and converts the duty ratio Dt to a sub-valve body duty ratio DTsub, which is 40%.

The first embodiment has the following advantages.

a) The main valve body 54 does not always follow the movement of the sub-valve body 52. The main valve body 54 is moved by electromagnetic force generated by the coil 48. Also, the sub-valve body 52 is moved by electromagnetic force generated by the coil 48. The current supplied to the coil 48 is controlled based on the relationship between the electromagnetic force and the forces of the first and second ring springs 58, 60 acting on the valve bodies 54, 52. This permits the sub-valve body 52 to open and close the orifice 54*b* while the main valve body 54 holds the supply hole 62*b* closed.

The sub-valve body 52 can be opened independently from the main valve body 54 to selectively open the orifice 54*b*. This permits a required amount of fuel to be drawn into the pressurizing chamber 24 through the orifice 54*b* from the fuel supply passage 12. The cross-sectional area of the orifice 54*b* is smaller than that of the supply hole 62*b*, which is opened by the main valve body 54. Therefore, to draw the same amount of fuel into the pressurizing chamber 24, the period during which the sub-valve body 52 needs to open the orifice 54*b* is longer than the period during which the main valve body 54 needs to opens the supply hole 62*b*. Thus, when the load acting on the engine 4 is small and the required amount fuel is small, for example, when the engine 4 is idling, the sub-valve body 52 opens the orifice 54*b* for a relatively long period. This permits a small amount of fuel to be accurately supplied. In the illustrated embodiment, the high pressure fuel pump 2 is used in the in-cylinder fuel injection type gasoline engine 4, which performs stratified charge combustion. Therefore, when the load is small, the fuel injection amount is decreased. The illustrated embodiment accurately controls small fuel injection amount.

When the main valve body 54 and the sub-valve body 52 are actuated, the period between the actuation of the valve bodies 54 and 52 can be adjusted by controlling the electromagnetic force. That is, the period can be extremely short so that the valve bodies 52, 54 are moved substantially at the same time. This permits a relatively great flow rate of fuel to be quickly controlled. Alternatively, the period can be extended when, for example, the temperature of the fuel is relatively low and the viscosity of the fuel is low, so that the main valve body 54 is reliably opened after the difference in the pressures acting on the sides of the main valve body 54 is completely eliminated.

The sub-valve body 52 can be moved independently from the main valve body 54, and the period between the actuations of the sub-valve body 52 and the main valve body 54 can be adjusted, which permits the fuel flow control valve 20 to quickly and reliably operate. Accordingly, the fuel flow control valve 20 finely controls the flow rate of fuel in a wide range.

(B) The main valve body 54 and the sub-valve body 52, which are substantially flat and are made of high permeable magnetic materials, are stacked. This structure reduces the size of the fuel flow control valve 20. Also, since the valve bodies 52, 54 are light, a change in the electromagnetic force of the coil 48 is quickly reflected to the operation of the valve 20.

The sub-valve body 52 is held close to the main valve body 54 by force of the first ring spring 58 and the second ring spring 60. Also, the valve bodies 52, 54 are located close to the distal end 46*d* of the housing 46 and the distal end 50*c* of the core 50. This structure reduces the size of the fuel flow control valve 20.

(C) The arcuate openings 52*d* are formed about the center. The time at which the flux saturates in the sub-valve body 52 can be adjusted by changing the size and the arrangement of the openings 52*d*. Therefore, the force that acts on the sub-valve body 52 and the main valve body 54 is freely determined.

(D) The single coil 48 is used for controlling the electromagnetic force that acts on the main valve body 54 and the sub-valve body 52. The movement of the sub-valve body 52 is controlled by the level of the current supplied to the coil 48. Therefore, the size of the fuel flow control valve 20 is reduced and the structure is simplified, which reduces the cost.

(E) In the procedure of FIG. 15, the opening period of the main valve body 54 is controlled by adjusting the electromagnetic force generated by the coil 48 in accordance with the required fuel amount Q, which is varied based on the running state of the engine 4. At this time, the sub-valve body 52 can be opened immediately before the main valve body 54 is opened (S310). Therefore, the high pressure fuel pump 2 quickly and accurately actuates the main valve body 54 in accordance with the required fuel amount Q. In other words, an adequate amount of fuel is supplied to the engine 4. When the engine 4 requires a small amount of fuel, or when the outcome of S300 is negative, the main valve body 54 is maintained closed and the sub-valve body 52 is actuated (S330). Thus, the cross-sectional area of the fuel flow passage is decreased to that of the orifice 54*b*, which extends the period from when the valve 20 is open to when the valve 20 is closed. Accordingly, the flow rate of fuel is accurately controlled even if the flow rate of fuel is small.

In this manner, the high pressure fuel pump 2 accurately controls the flow rate of fuel in a wide range. Therefore, the controllable range of the fuel pressure in the distribution pipe 30 of the engine 4 is expanded, which permits the fuel pressure to be always reliably controlled. The engine 4 is therefore efficiently controlled.

It should be apparent to those skilled in the art that the present invention may be embodied in many other specific forms without departing from the spirit or scope of the invention. Particularly, it should be understood that the invention may be embodied in the following forms.

The high pressure fuel pump 2 may be used in engines other than the gasoline engine 4. For example, the pump 2 may be used in a diesel engine.

The electromagnetic valve 20 according to the present invention may be used for controlling the flow of fluid other than fuel.

In the illustrated embodiment, the main valve body 54 has one orifice 54*b*. However, two or more orifices may be formed in the main valve body 54 and the sub-valve body 52 may selectively open and close the orifices.

In the illustrated embodiment, the force of the spring 42 lowers the plunger 22 and increases the volume of the pressurizing chamber 24 after the sub-valve body 52 and the main valve body 54 close the orifice 54*b* and the supply hole 62*b* to stop drawing fuel during the intake stroke. However, the force of the spring 42 may be adjusted such that the plunger 22 is not lowered after fuel is drawn. In this case, the bottom 38*a* of the lifter 38 is separated from the cam 44 after fuel is drawn into the pressurizing chamber 24. As each cam nose 44*a* approaches, the lifter bottom 38*a* contacts the cam 44 again. Therefore, the plunger 22 decreases the volume of the pressurizing chamber 24 to compress and discharge the drawn fuel.

In the illustrated embodiment, the main valve body 54 has a single bypass passage, which is the orifice 54*b*, and the sub-valve body 52 closes and opens the bypass passage. However, two or more bypass passages may be formed in the main valve body 54, and each bypass passage may be independently opened and closed by one of a plurality of sub-valve bodies.

In the illustrated embodiment, the main valve body 54 has a single bypass passage, which is the orifice 54*b*, and the sub-valve body 52 closes and opens the bypass passage. However, two or more stacked sub-valve bodies may be located on the main valve body 54. In this case, each sub-valve body, except for the sub-valve body located farthest from the main valve body, has a through hole aligned with the orifice 54*b*. The orifice 54*b* is opened when all the sub-valve bodies are separated from the main valve body 54. Also, the fuel flow can be controlled by separating an adjacent pair of the sub-valve bodies.

Therefore, the present examples and embodiments are to be considered as illustrative and not restrictive and the invention is not to be limited to the details given herein, but may be modified within the scope and equivalence of the appended claims.

What is claimed is:

1. An electromagnetic control valve comprising:

a passage for conducting fluid;

an electromagnetic actuator for generating an electromagnetic force;

a main valve body for opening and closing the passage in accordance with the electromagnetic force generated by the electromagnetic actuator;

a bypass formed in the main valve body; and a sub valve body for opening and closing the bypass in accordance with the electromagnetic force generated by the electromagnetic actuator, wherein the electromagnetic force generated by the electromagnetic actuator is adjusted such that the sub valve body is opened and closed while the main valve body closes the passage.

2. The electromagnetic control valve according to claim 1 further comprising:

a first urging member for urging the main valve body in a direction that is opposite to the direction in which the electromagnetic force generated by the electromagnetic actuator is applied to the main valve body;

a second urging member for urging the sub valve body in a direction that is opposite to the direction in which the electromagnetic force generated by the electromagnetic actuator is applied to the sub valve body, wherein the electromagnetic force generated by the electromagnetic actuator is adjusted based on a predetermined relationship between the forces applied by the urging members and the forces applied to each valve body in accordance with the electromagnetic force generated by the electromagnetic actuator, and the relationship is determined such that the sub valve body can open and close while the main valve body closes the passage.

3. The electromagnetic control valve according to claim 2, wherein the electromagnetic actuator has an electromagnetic coil, which adjusts the electromagnetic force in accordance with a supplied electric current.

4. The electromagnetic control valve according to claim 3, wherein the main valve body is made of a highly permeable magnetic material.

5. The electromagnetic control valve according to claim 3, wherein the sub valve body is made of a highly permeable magnetic material.

6. The electromagnetic control valve according to claim 2, wherein the main valve body is urged by the first urging member in a direction to close the passage and is urged by the electromagnetic force generated by the electromagnetic actuator in a direction to open the passage, wherein the sub valve body is urged by the second urging member in a direction to close the bypass and is urged by the electromagnetic force generated by the electromagnetic actuator in a direction to open the bypass.

7. The electromagnetic control valve according to claim 2, wherein the main and sub valve bodies are made of a highly permeable magnetic material, wherein the sub valve body is stacked on the main valve body in a vertical direction and is urged by the second urging member in a direction to close the bypass.

8. The electromagnetic control valve according to claim 7, wherein the main and the sub valve bodies are each disk-shaped, and the electromagnetic actuator forms the magnetic circuit in a radial direction, wherein the electromagnetic force acts on both valve bodies such that the main valve body opens the passage and the sub valve body opens the bypass.

9. A high pressure pump comprising:

a high pressure chamber;

a passage for supplying fluid to the high pressure chamber; and an electromagnetic control valve for controlling the amount of fluid that enters the high pressure chamber through the passage, the electromagnetic control valve comprising:

an electromagnetic actuator for generating an electromagnetic force;

a main valve body for opening and closing the passage in accordance with the electromagnetic force generated by the electromagnetic actuator;

a bypass formed in the main valve body, wherein the bypass connects an upstream part of the main valve body to a downstream part of the main valve body; and a sub valve body for opening and closing the bypass in accordance with the electromagnetic force generated by the electromagnetic actuator, wherein the electromagnetic force generated by the electromagnetic actuator is adjusted such that the sub valve body is opened and closed while the main valve body closes the passage.

10. The high pressure pump according to claim 9, wherein a check valve is located between the high pressure chamber and the electromagnetic control valve, and wherein the check valve prevents fluid from flowing from the high pressure chamber to the electromagnetic control valve.

11. A high pressure pump used for supplying fuel to an internal combustion engine, the high pressure pump comprising:

a high pressure chamber;

a passage for supplying fuel to the high pressure chamber;

an electromagnetic control valve for controlling the amount of fuel that enters the high pressure chamber through the passage, the electromagnetic control valve comprising:

an electromagnetic actuator for generating an electromagnetic force;

a main valve body for opening and closing the passage in accordance with the electromagnetic force generated by the electromagnetic actuator;

a bypass formed in the main valve body, wherein the bypass connects an upstream part of the main valve body to a downstream part of the main valve body; and a sub valve body for opening and closing the bypass in accordance with the electromagnetic force generated by the electromagnetic actuator; and a controller for controlling the electromagnetic control valve to adjust the flow rate of fuel in accordance with the flow rate of fuel required by the engine, wherein, when the flow rate of fuel required by the engine is less than a predetermined value, the controller controls the electromagnetic force such that the sub valve body is opened and closed while the main valve body closes the passage.

12. The high pressure pump according to claim 11, wherein, when the flow rate of fuel required by the engine is greater than a predetermined the flow rate, the controller controls the electromagnetic force such that both valve bodies open and close.

13. The high pressure pump according to claim 11, wherein the controller adjusts the period during which the main valve body opens the passage in accordance with the flow rate of fuel required by engine, and the controller controls the electromagnetic actuator such that the sub valve body opens the bypass immediately before the main valve body opens the passage.

* * * * *